United States Patent [19]

Peiffer

[11] Patent Number: 4,904,344

[45] Date of Patent: Feb. 27, 1990

[54] AUTOMATIC WEB THREADING APPARATUS AND METHOD

[75] Inventor: Robert E. Peiffer, Beloit, Wis.

[73] Assignee: Beloit Corporation, Beloit, Wis.

[21] Appl. No.: 339,538

[22] Filed: Apr. 17, 1989

[51] Int. Cl.[4] ..... D21F 1/36; D21F 7/00

[52] U.S. Cl. ..... 162/193; 162/194; 162/255; 162/286

[58] Field of Search ..... 162/193, 194, 255, 283, 162/286; 34/120; 493/342, 363, 369; 83/98, 99

[56] References Cited

U.S. PATENT DOCUMENTS

| | | | |
|---|---|---|---|
| 3,113,348 | 12/1963 | Varga | 19/106 R |
| 3,355,349 | 11/1967 | Devlin | 162/193 |
| 4,136,808 | 1/1979 | Reba | 226/7 |
| 4,179,330 | 12/1979 | Page | 162/113 |
| 4,182,472 | 1/1980 | Peekna | 226/97 |
| 4,321,107 | 3/1982 | Page | 162/198 |
| 4,342,413 | 8/1982 | Reba | 226/97 |
| 4,501,643 | 2/1985 | Kiuru | 162/286 |
| 4,543,160 | 9/1985 | Kerttula et al. | 162/193 |
| 4,648,942 | 3/1987 | Wanke et al. | 162/286 |
| 4,684,443 | 8/1987 | Kerttula et al. | 162/255 |
| 4,692,215 | 9/1987 | Kerttula | 162/289 |
| 4,726,502 | 2/1988 | Cryderman | 226/97 |
| 4,818,343 | 4/1989 | Laine | 162/193 |

*Primary Examiner*—Karen M. Hastings

*Attorney, Agent, or Firm*—Dirk Veneman; Raymond Campbell; Gerald Mathews

[57] ABSTRACT

A method and apparatus for automatically threading a traveling web strip, such as a so-called paper tail in a papermaking machine, utilizes a doctor for doctoring the web strip from the surface of a roll. A stream of compressed air is projected against the oncoming web strip in the vicinity of the point where the doctor blade contacts the web on the roll and urges the oncoming web off the roll surface upstream of the doctor. A foil is brought into proximity with the outer surface of the web spaced over the roll to urge the strip outwardly and against a serrated knife to sever the web strip against the force of its momentum. The severed end of the web strip is then guided onto a plate for conveyance into a downstream section of the machine for further processing.

10 Claims, 4 Drawing Sheets

AUTOMATIC WEB THREADING APPARATUS AND METHOD

BACKGROUND OF THE INVENTION

This invention relates to the threading of a travelling web strip through process machinery incorporating rotating rolls. More specifically, this invention relates to a method and apparatus for automatically threading the so-called "tail" in a papermaking machine from a roll on which the web is applied to its surface, such as a calender roll, downstream to other apparatus, such as a dryer section. Still more particularly, this invention relates to the combination of a doctor operating against the paper tail on the calender roll to urge the tail into proximity with a foil which, in turn, urges the moving tail away from the calender roll and against a knife to sever the tail and simultaneously direct the severed end onto a support plate for conveyance downstream.

In today's papermaking industry, as speeds become faster, safety and operating regulations become more stringent, and the cost of delay in bringing a papermaking machine up to operating speed after a paper break becomes more significant, there has developed a long-felt need for apparatus which can thread the paper web by way of a paper tail, or narrow portion of the web called a strip, automatically from one section of the machine to another. Heretofore, such threading was often accomplished either by hand, where a machine tender would take the strip and guide it in the open space between sections and then toss it into the next section of the machine where it might be nipped between rolls, or handled by some sort of hand held or manually actuated apparatus. Most prior threading techniques involved either manual, semi-manual, or labor intensive apparatus which was not reliable and seldom operable completely from a benchboard so as to satisfy today's employer safety rules.

Other prior apparatus for guiding a travelling strip of paper from one section to another in a papermaking machine are disclosed in U.S. Pat. Nos. 4,179,330 and 4,501,643.

Prior web threading apparatus, while often utilizing such considerations of web guidance and conveyance as the Coanda effect and the use of a cushion of air over a support plate, have not provided the degree of automatic web threading desired and required in some operational configurations of papermaking machinery. In addition, prior web threading apparatus often required human assistance in manipulating the apparatus to "automatically" thread the machine. Even then, often the tail would be directed into the downstream apparatus upon rethreading the machine where it would sometimes accumulate within the machinery, or slacken, before the tail could be expanded to the full width web for continuous operation. Finally, prior arrangements did not combine automatic benchboard controlled threading with the step of severing the web strip.

SUMMARY OF THE INVENTION

This invention obviates the shortcomings and deficiencies described above in conjunction with prior web threading apparatus. In this invention, upon initial start-up or a sheet break in a papermaking machine operating at full speed, the newly formed paper tail, or web strip, is automatically doctored from the calender roll surface by a doctor which has a blade width corresponding to the width of the web strip. If the doctor blade is maintained in constant contact with the surface of the calender roll, no automatic web break detection equipment is required to intercept the web strip, and no operator is required to initiate any action regarding interception, transference and guidance of the strip. Optionally, the doctor can be in a retracted position during normal machine operation and then activated by a web-break detector in the event of a sheet break. Either way, the apparatus can be controlled entirely from a benchboard.

It is an object of this invention to provide a completely automatic web threading method and apparatus which operates independent of manual involvement by mill personnel.

Another object of this invention is to provide a method and apparatus for threading a web which does not create slack in the span between the sections of the apparatus between which the web is transferred.

Still another object of this invention is to combine a positive and continuous web threading arrangement combined with a web severing function.

A feature of this invention is the use of a web guidance foil disposed above the web over the point where it is initially guided away from a roll surface.

These and other objects, features and advantages of the invention, its construction and operation will be best understood from the following detailed description taken in conjunction with the accompanying drawings.

DESCRIPTION OF THE PREFERRED EMBODIMENT

Figure 1:
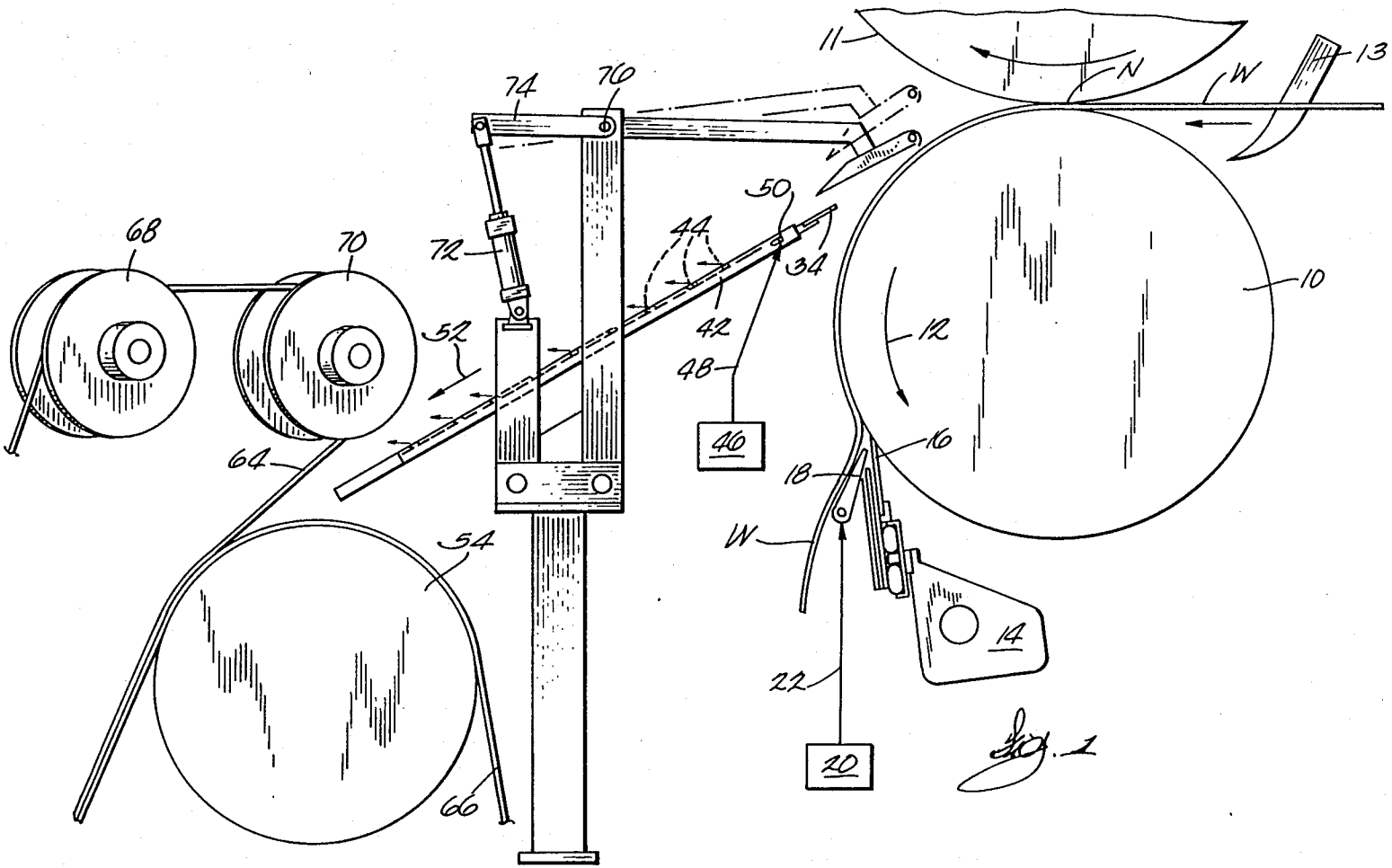
FIG. 1 is a side-elevational view of the apparatus of this invention disposed between a calender stack and a downstream dryer roll.

As shown in FIG. 1, an oncoming web strip W is shown as it travels on the surface of a lower calender roll 10, which is turning in the direction of arrow 12. The web strip could be produced at any upstream location in the papermaking machine as shown somewhat schematically by knife 13. A doctor 14 is disposed with its blade 16 in continuous engagement with the surface of roll 10 at a position downstream of the nip N between co-rotating calender rolls 10,11. Disposed above the doctor blade 16, and preferably mounted on the doctor itself, is a source of compressed air, such as an apertured nozzle 18, connected to an air compressor 20 via line 22. Nozzle 18 directs compressed air along the outer surface of the doctor blade against the direction of the oncoming web strip to urge the web strip, in conjunction with the doctoring function of the doctor blade, outwardly and away from the surface of calender roll 10.

Figure 3:
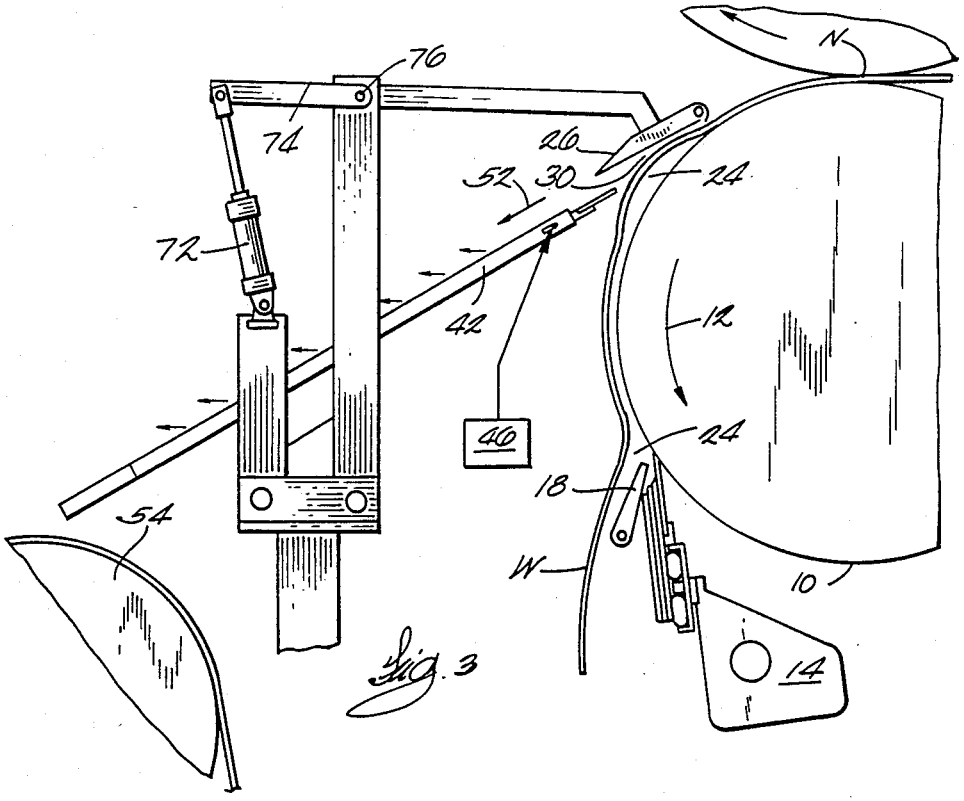
FIGS. 3 to 6 are somewhat schematic representations of the web and lower roll of the calender stack showing how the web is separated from the calender roll and guided into position for severance and conveyance downstream.
Figure 4:
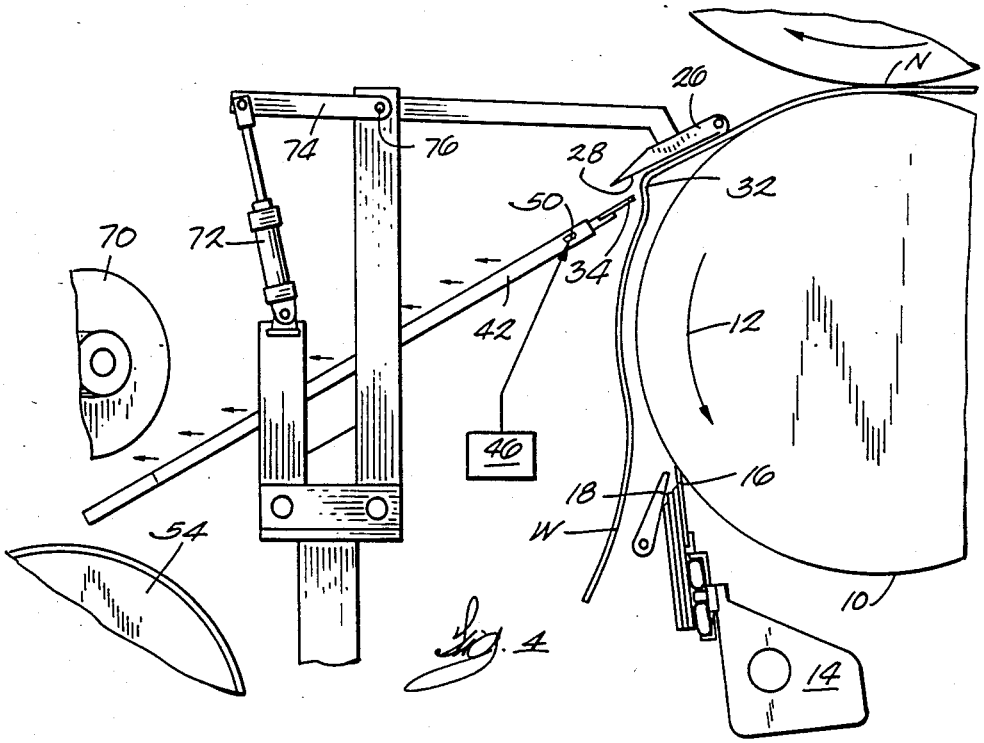
Figure 5:
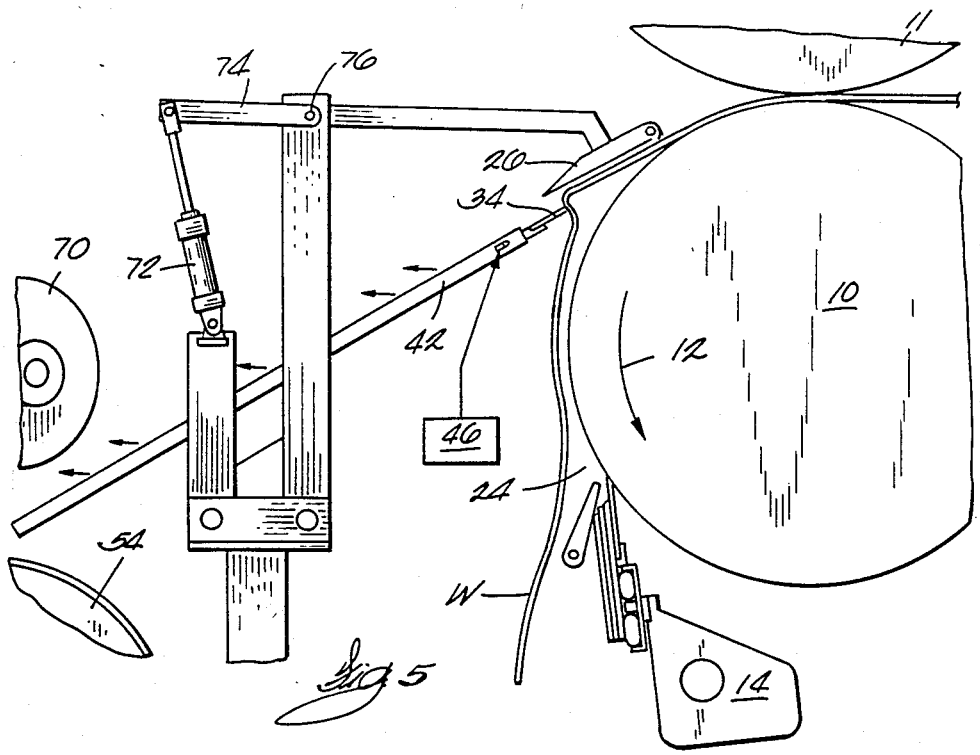

Once the web strip W has begun to pull away from the surface of roll 10, a cushion of compressed air establishes and begins to maintain a first space 24 between the web strip and the surface of the roll 10. This is shown in FIG. 3.

Figure 8:
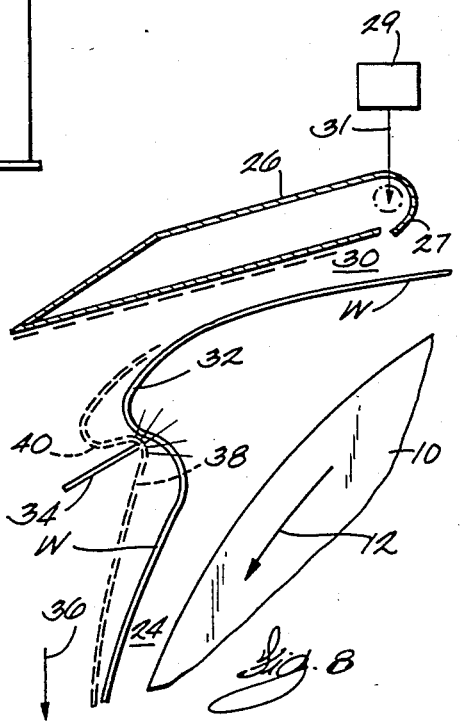
FIG. 8 is an enlarged view of the web severing function in conjunction with its guidance by the foil.
Figure 7:
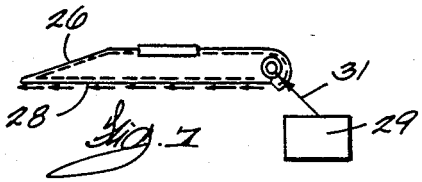

Referring to FIGS. 3, 4, 5 and 7, a foil 26 is pivotally brought into proximity with the outer (upper) surface of the now unsupported web strip near an upper portion thereof just downstream of nip N. Depending on the configuration of the outer surface 28 of the foil, and whether compressed air is utilized, as explained below, the presence of the foil creates a second space 30 above the web strip which has a lower pressure than the ambient air pressure and, in particular, a lower pressure than the air pressure in first space 24. This produces a small bight 32, as shown in an early formative stage in FIG. 3 and in a more developed stage in FIG. 4. The bight, in combination with the lower air pressure in second space 30 between the outer surface of the web and the functional surface 28 of the foil, and in conjunction with the momentum of the web now travelling outwardly substantially tangentially to the surface of calender roll 10, operates to fold the web strip bight over the edge of a serrated knife 34 such that the momentum of the downstream portion of the web strip going in an essentially downward direction, shown by arrow 36, which is at an angle to the portion of the web upstream of the serrated knife, provides the momentum to sever the web over the serrated knife. This is shown more clearly in FIG. 8.

Figure 6:
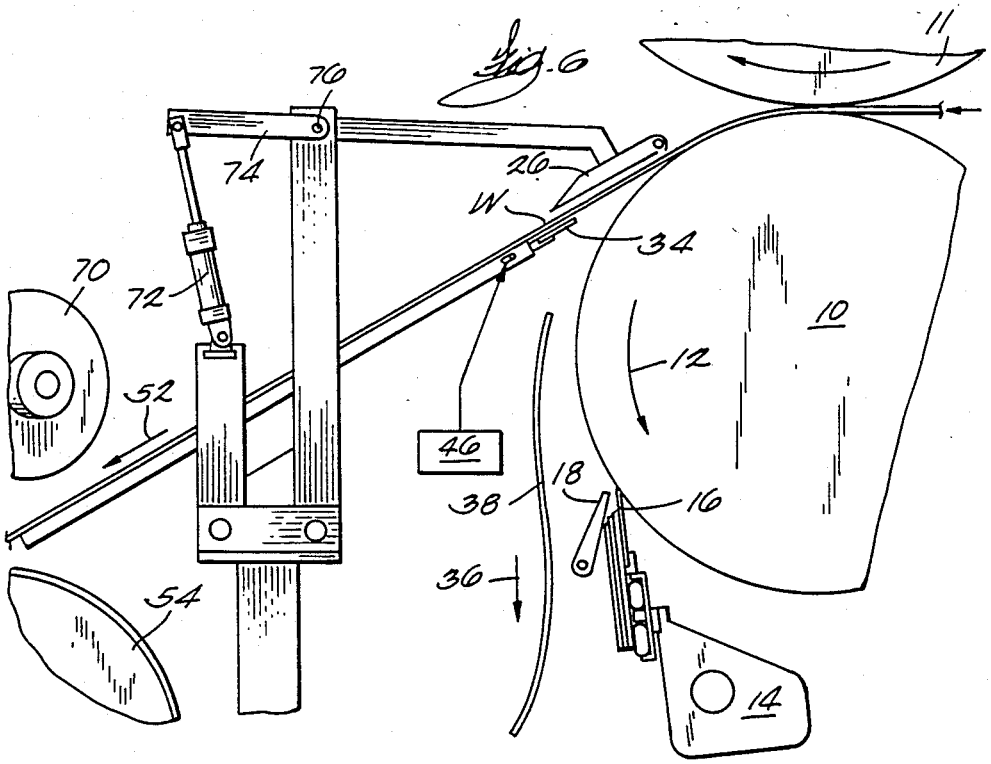

At this point, as shown in FIG. 6, the lower portion 38 of the severed web strip continues to travel downwardly into a broke pit while the end of the upper portion 40 of the severed web strip continues to travel over the top of the serrated knife and onto a support plate 42. The support plate 42 is equipped with a plurality of apertures 44 in its surface which, in turn, are linked to a source 46 of compressed air which is linked through an appropriate line 48 to a coupling 50 in the upper end of the support plate 42. The source of compressed air then supplies a supporting cushion of air over the outer surface of the support plate to support and assist in conveying the web downwardly, in the machine direction 52, toward paper roll 54.

Figure 2:
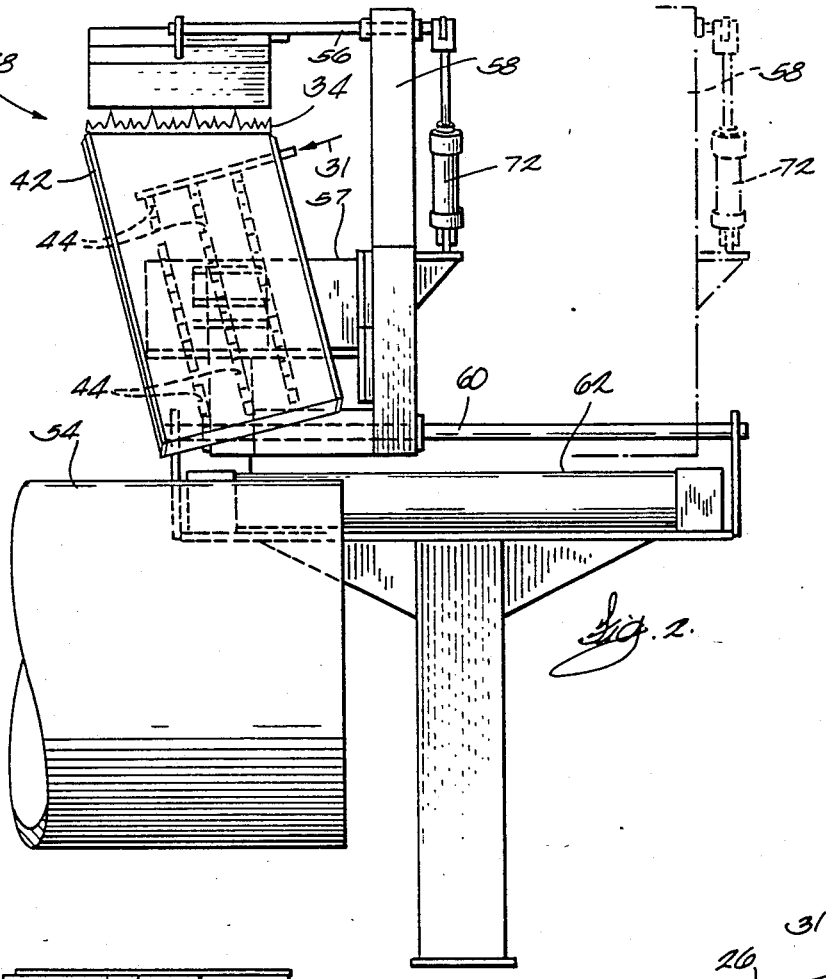
FIG. 2 is an end view in the direction of web travel of the apparatus shown in FIG. 1.
Figure 7A:
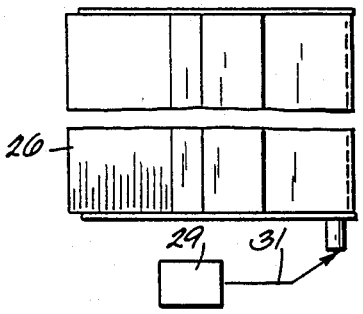
FIGS. 7 and 7A are side and plan views of the foil shown in FIGS. 3 to 6.

With reference to FIG. 2, the foil 26 is mounted on a traversing rod 56 which, in turn, is mounted in a mounting bracket 58 at one side of the papermaking machine. In a similar manner, the support plate 42 is also mounted on brackets 57 and 58 and the entire supporting bracket 58 is mounted on a bar slide 60 which is reciprocally actuated into and out of position over the edge of paper roll 54 by an air cylinder 62 in a manner well-known to those skilled in the art. As can be seen in FIG. 2, the support plate 42 or paper tail trim chute, as it might be more commonly referred to in the papermaking industry, is angled so as to direct the web strip to the edge of the paper roll 54 where it will be secured between the co-running ropes 64,66 (FIG. 1) for further threading through the serpentine path of paper web travel in the dryer section of the papermaking machine. The upper rope 64 is shown being guided over sheeves 68,70.

The foil itself can be pivotally brought into and out of operating proximity with the outer surface of the web strip by reciprocal actuation of air cylinder 72 which pivots the arm 74 on which the foil is mounted about a pivot 76. The operating position of foil 26 is shown in solid lines in FIG. 1 and the non-operating position is shown in dotted lines. In its operating position, foil 26 is above the plane of the surface of support plate 42.

Operation of air cylinder 62 permits the entire web strip transfer apparatus 78 to be moved into and out of position, as desired, to enable the full width of the paper web to run on the machine after the web strip has been threaded.

In operation, the doctor 14 is preferably maintained in position with its blade 16 applied to the surface of calender roll 10 to automatically intercept the tail, or web strip W, in the event of a sheet break and a new web strip is produced in the forming section of the papermaking machine. Accordingly, this is independent of any action by a machine tender, if desired. The web transfer apparatus is then positioned by operation of air cylinder 62 so that the web strip W, which has been separated from the surface of the calender roll 10 and first space 24 has been established, is brought into guiding influence of foil 26 which, as previously explained, guides the web strip over the serrated knife to both sever the web strip and convey the severed end over the support plate 42 for positive conveyance downstream where it passes into the grip of converging, co-running ropes 64,66.

As previously stated, in the preferred embodiment, foil 26 is also equipped with one or more orifices, which may take the form of a continuous slot 27 (FIG. 8), to direct compressed air from a source 29 (FIG. 7), such as an air compressor, from a line 31 to a pipe within the foil so that the compressed air is directed along the surface 28 of the foil to produce rapid air flow and corresponding relatively lower pressure adjacent to the foil surface 28 according to the Bernoulli principle.

The apparatus is therefore seen to operate automatically and continuously, as desired, to lift the web strip W off the surface of calender roll 10 with the air of doctor 14. A first space 24 between the web strip and surface of roll 10 is established and maintained by the compressed air stream flowing against the direction of the oncoming web strip from nozzle 18.

Foil 26 is brought into proximity with the outer surface of the web over the upper quadrant of the calender roll 10. The Bernoulli effect produced by the foil and moving web strip, with or without enhancement by compressed air moving along the outer surface 28 of foil 26, produces a sub-atmosphere air pressure in the second space 30 between foil surface 28 and the outer surface of the web strip W. This urges the web strip to move outwardly from the surface of roll 10 and a bight 32 is formed between the foil and surface of roll 10. The momentum of the traveling web strip upstream of the bight and near the surface 28 of foil 26 urges that upstream portion to travel over the top of serrated knife 34. Similarly, the momentum of the downstream portion of the web near doctor 14, in conjunction with the Coanda effect of the air moving with the web over its outer surface, combine to cause the web at or near the bight 32 to press against the serrated knife 34 to sever the web strip.

The severance of the web strip is accomplished without moving the knife. In fact, knife 34 has only one position regardless of whether a web strip is running, or whether the full width web is running, or whether the web strip is being severed. This allows the web strip to be severed by knife 34, guided by foil 26 and conveyed downstream by support plate 42 merely by separating the oncoming web strip from the surface of calender roll 10. This can be done automatically by doctor 14 and air nozzle 18.

Naturally, modifications can be made without departing from the spirit and scope of the invention. For example, foil 26 can have an operating surface 28 in a variety of configurations. Also, compressed air need not be directed along its surface to create the space 30 of reduced atmospheric pressure. It is only important that the surface 28 and attitude of the foil, with or without operation in conjunction with a stream of compressed air, be such as to produce the aforementioned desired pressure in space 30. Finally, the type of rolls 10,54 between which the web strip is guided is not limited to calender and paper rolls.

What is claimed is:

1. Apparatus for guiding and conveying a traveling web strip having an outer surface in a web processing apparatus from one section of the apparatus to a downstream section of the apparatus, the apparatus including a first roll having a surface on a portion of which the strip is supported, the combination comprising:

strip deflector means for separating the web strip from the first roll and maintaining a first space between the traveling strip and a portion of the first roll surface over which it is disposed;

foil means above the strip over the first roll for establishing a second space between the foil means and the outer surface of the strip over the first space, said foil means structured and arranged to establish in the second space a pressure lower than the pressure on the side of the web in the first space facing the first roll, whereby the strip is guided away from the first roll;

web strip severing means disposed adjacent the foil means for intercepting the web strip between the first and second spaces and for severing the web strip;

support plate means located in a plane and downstream of the web strip severing means for receiving the upstream portion of the severed strip and conveying the strip to the downstream section for further processing.

2. Apparatus for guiding and conveying a traveling web strip as set forth in claim 1, wherein:

the foil means includes a foil surface defining the foil side of the second space, the foil surface arranged to create sub-atmospheric air pressure above the moving web strip and disposed above the plane of the support plate means.

3. Apparatus for guiding and conveying a traveling web strip as set forth in claim 2, wherein:

the foil means includes a source of compressed air and one or more apertures for directing the compressed air over the foil surface to enhance creation of a lower pressure in the second space and the pressure differential between the second and first spaces.

4. Apparatus for guiding and conveying a traveling web strip as set forth in claim 1, wherein:

the strip deflector means includes a doctor and a source of compressed air and one or more apertures for projecting compressed air adjacent the distal edge of the doctor blade for interfering with the web strip being doctored from the roll to thereby establish and maintain the first space between the web strip and surface of the first roll.

5. Apparatus for guiding and conveying a traveling web strip as set forth in claim 1, wherein:

the support plate means includes a source of compressed air and a plurality of apertures for establishing a layer of air over the support plate means and enhancing the conveyance of the web strip over a surface of the support plate.

6. Apparatus for guiding and conveying a traveling web strip as set forth in claim 1, wherein:

the web strip severing means comprises a knife blade mounted to the upstream end of the support plate means toward the portion of the strip being guided away from the first roll.

7. Apparatus for guiding and conveying a traveling web strip as set forth in claim 1, wherein:

the web strip severing means is downstream of the foil means.

8. Apparatus for guiding, severing and conveying a traveling web in a web processing apparatus from one section of the apparatus to another section of the apparatus, the apparatus including a first roll on which the strip is supported and a second roll downstream in spaced adjacency to the first roll, the combination comprising:

slitting means associated with the web to, cut a longitudinally extending web strip having an outer surface in the web on one side thereof;

strip deflector means, including a doctor having a blade disposed to intercept the web strip on the first roll and an orifice means for projecting compressed air along the distal edge of the doctor blade and against the web strip, whereby the web strip is separated from the first roll and a first space is established and maintained between the web strip and first roll;

foil means above the strip over the first roll for establishing a second space between the foil means and the outer surface of the strip over the first space, said foil means structured and arranged to establish in the second space a pressure lower than the pressure in the first space, whereby the strip is guided away from the first roll;

a web strip knife disposed downstream of the foil means to intercept portion of the web strip guided away from the first roll;

a support plate downstream of the knife for receiving the upstream portion of the severed strip and conveying the strip to the second roll for further processing.

9. A method for automatically guiding and conveying a traveling web strip in a web processing apparatus from one section of the apparatus to another section of the apparatus, the apparatus including a first roll on which the strip is supported and a second roll downstream in spaced adjacency to the first roll, the steps including:

separating the oncoming web strip from the surface of the first roll to establish a first space between the web strip and the surface of the first roll;

maintaining the first space between the traveling web strip and the first roll over which it is disposed;

guiding an upstream portion of the strip away from the surface of the first roll and producing a bight portion in the web strip by using a foil means above the strip over the first roll and thereby establishing a second space between the foil means and the outer surface of the strip over the first space, said foil means establishing in the second space a pressure lower than the pressure on the side of the web in the first space facing the first roll; directing the bight portion the guided web strip onto a web severing means to sever the web strip; supporting the oncoming severed end of the web strip for a substantial distance;

conveying the traveling web strip into the downstream section of the web processing apparatus.

10. A method for guiding and conveying a traveling web strip as set forth in claim 9, wherein:

the separation of the web strip from the first roll and maintenance of the first space between the traveling web strip and the surface of the first roll is continuous.

* * * * *